United States Patent [19]

Momono et al.

[11] Patent Number: 4,520,962

[45] Date of Patent: Jun. 4, 1985

[54] MAGNETIC FUEL INJECTION VALVE

[75] Inventors: Masakichi Momono; Hisanori Moriya; Masahiro Souma; Eiji Hamashima, all of Katsuta, Japan

[73] Assignees: Hitachi, Ltd.; Hitachi Automotive Engineering Co., Ltd., both of Tokyo, Japan

[21] Appl. No.: 344,802

[22] Filed: Feb. 1, 1982

[30] Foreign Application Priority Data

Jan. 30, 1981 [JP] Japan ..... 56-13486

[51] Int. Cl.[3] ..... F02M 51/08

[52] U.S. Cl. ..... 239/585

[58] Field of Search ..... 239/585, 490, 491, 533.9, 239/533.12, 492, 493

[56] References Cited

U.S. PATENT DOCUMENTS

| | | | |
|---|---|---|---|
| 3,731,880 | 5/1973 | Williams | 239/585 |
| 4,186,883 | 2/1980 | Robling | 239/491 |
| 4,216,753 | 8/1980 | Inoue et al. . | |
| 4,218,021 | 8/1980 | Palma | 239/585 |

FOREIGN PATENT DOCUMENTS

| | | | |
|---|---|---|---|
| 51009 | 10/1981 | European Pat. Off. . | |
| 857891 | 10/1940 | France . | |
| 2127146 | 10/1972 | France . | |
| 424879 | 9/1947 | Italy | 239/491 |

*Primary Examiner*—Andres Kashnikow

*Attorney, Agent, or Firm*—Antonelli, Terry & Wands

[57] ABSTRACT

A fuel inlet opens at one end between a valve seat and an inner surface of a valve housing on which a globe valve slides. The other end of the fuel inlet opens to an external surface of the valve housing. The fuel inlet runs almost in the direction of a central axis of the globe valve so as to prevent the formation of vortex flow around the globe valve. A spiral member is pressure fitted inside the valve housing immediately downstream of the valve seat with the spiral member being formed as a rod with a spiral fuel groove to swirl the fuel along the groove. An outlet orifice for fuel metering is formed immediately downstream of and as near as possible to the spiral member.

7 Claims, 3 Drawing Figures

MAGNETIC FUEL INJECTION VALVE

BACKGROUND OF THE INVENTION

This invention relates to a magnetic fuel injection valve for internal combustion engines and, more particularly, to a fuel injection valve which employs a globe valve for improving an atomization fuel injection.

The conventional magnetic fuel injection valve using a globe valve as a valve disk has an advantage over a pintle type fuel injection valve in that there is a greater allowance for the inclination of the valve disk relative to the valve seat. This greater allowance permits reduction in machining accuracy of valve housing and, therefore, the reduction in the manufacturing cost while at the same time reducing the weight of the moving parts including the valve disk so as to result in an improvement in the response speed of the valve disk. However, a disadvantage of the conventional fuel injection valve resides in the fact that it is difficult to work on the globe valve to increase the diffusing angle of fuel spray and, consequently poor fuel atomization results.

A fuel injection valve is known in which the fuel is supplied at high speed from the inlet orifice into a vortex chamber, with the inlet orifice being cut through the valve housing from the external surface to the inner surface in a direction tangent to an outer surface of the glove valve. The vortex chamber is enclosed by a inner surface of the valve housing, an outer surface of the globe valve and the valve seat, so that the supplied fuel swirls in the vortex chamber to increase the diffusing angle of the fuel spray injected out of the outlet orifice. In this fuel injection valve, since the fuel circles or swirls around upstream of the valve seat, the apparent flow coefficient at the valve seat is small, so that it is necessary to increase the valve stroke to obtain the fuel passage area at the valve seat. However, increasing the valve stroke results in an increase in the time it takes for the globe valve to travel through the full stroke. This time increase increases the speed at which the moving unit, made up of the globe valve, plunger and rod, strikes against the stopper, with the resulting rebounding movement making the amount of fuel injection unstable. A further disadvantage of this fuel injection valve resides in the fact that, if the fuel is metered by the outlet orifice, the fuel remaining in the vortex chamber just prior to the opening of the valve flows out of the outlet orifice without being swirled thereby resulting in the apparent orifice flow coefficient becoming greater than in the normal condition. This flow of fuel remaining in the vortex chamber causes an excess amount of fuel to be injected when the valve begins to open, making it difficult to control the fuel flow in the small fuel flow range. When the fuel is metered by the inlet orifice, usually three or more inlet orifices are required to be arranged in parallel to ensure a uniform atomization. However, the provision of three or more inlet orifices and requires a reduction in a diameter of the inlet orifices and consequently highly accurate machining. Yet another fuel injection valve is known wherein a spiral member is provided downstream of the valve seat to increase the diffusion angle of fuel spray. In this fuel injection valve, the fuel is given a swirling motion at the downstream side of the valve seat, so as to avoid the above noted disadvantage. However, a disadvantage of this known fuel injection valve resides in the fact that since the fuel is supplied from the opposite side of the valve seat, the fuel must flow through the center of the coil, the fuel passage in the plunger and around the globe valve to reach the valve seat thereby creating a flow resistance. Therefore, when the valve is open, the fuel pressure immediately upstream of the valve seat decreases, reducing the flow speed of the fuel passing through the fuel passage groove resulting in an insufficient diffusing angle of fuel spray at the start of fuel injection. Another disadvantage of this kwown fuel injection valve resides in the fact that because the glove valve is not guided, the movement of the valve is unstable.

SUMMARY OF THE INVENTION

The object of this invention is to provide a magnetic fuel injection valve which overcomes the disadvantages mentioned above and which improves the diffusing angle of the fuel spray when the valve begins to open, i.e., when the fuel begins to be injected, and performs an excellent control on the fuel injection in the small pulse width range or the small fuel flow range.

In accordance with the invention the fuel from the fuel pressure source is supplied, without any swirling motion, to a position immediately upstream of the valve seat of the globe valve, with means being provided immediately downstream of the valve seat for swirling the fuel in a direction perpendicular to a direction of injection, and a fuel metering orifice is provided immediately downstream of the swirling means.

DESCRIPTION OF THE PREFERRED EMBODIMENT

Figure 1:
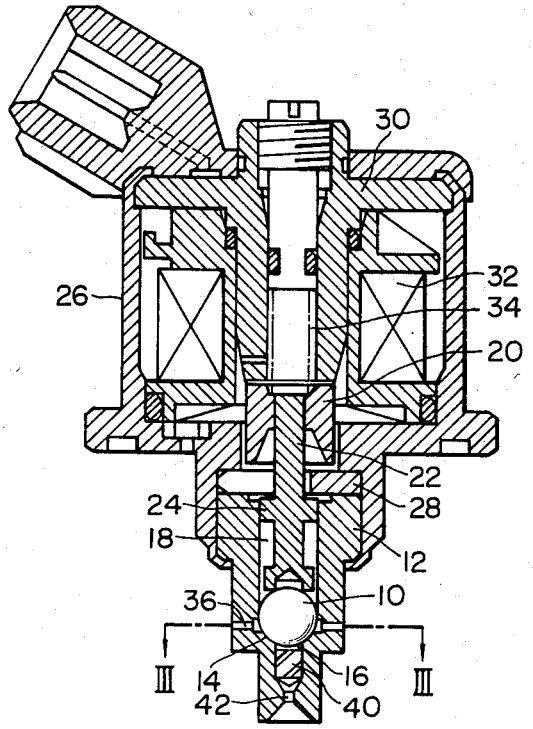
FIG. 1 is a cross sectional view of a magnetic fuel injection valve constructed in accordance with the present invention.
Figure 2:
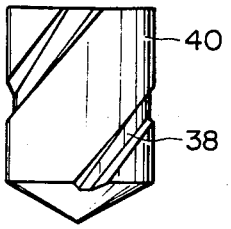
FIG. 2 is a plan view of a spiral member of the valve of FIG. 1.
Figure 3:
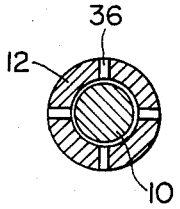
FIG. 3 is a cross sectional view taken along the line C—C in FIG. 1.

Referring now to the drawings wherein like reference numerals are used throughout the various views to designate like parts and, more particularly, to FIG. 1, according to this figure, a globe valve 10, cooperable with a valve seat 14, is reciprocated in the valve housing 12 to open and close a fuel passage 16. The globe valve 10 is integrally connected with the plunger 20 through the rod 18, with the globe valve 10, rod 18, and plunger 20 forming a moving unit 22. The moving unit 22 is contained in the valve housing 12 and a yoke 26 so as to be slidable in an axial direction of the valve housing 12 and the yoke 26 and it is guided by an outer surface of the globe valve 10 and a collar 24 of the rod 18. The collar 24 abuts a stopper 28 provided between the valve housing 12 and the yoke 26 and determines the stroke of the globe valve 10. The valve housing 12 and the stopper 28 are fixed inside the yoke 26, and a core 30 is provided at a center of the yoke 26, with a a coil 32 being installed between the yoke 26 and the core 30. One end of the core 30 opposes one end of the plunger 20 with an air gap therebetween. The yoke 26, core 30 and plunger 20 are formed of soft magnetic material and form a magnetic circuit. A spring 34 for urging the plunger 20 toward the valve seat 14 is provided between the plunger 20 and core 30. A fuel inlet 36 opens at one end between the valve seat 14 and the inner surface of the valve housing 12 on which the globe valve 10 slides. The other end of the fuel inlet 36 opens to the external surface of the valve housing 12. The fuel inlet 36 runs almost in the direction of the central axis of the globe valve 10 so as to prevent the formation of vortex flow around the globe valve 10. A spiral member 40 is fitted under pressure inside the valve housing 12 immediately downstream of the valve seat 14, with the spiral member 40 being formed as a rod with a spiral fuel groove 38 for swirling the fuel along the groove 38. An outlet orifice 42 for fuel metering is formed immediately downstream of and as near as possible to the spiral member 40.

With the fuel injection valve of this invention, when the coil 32 is energized, the plunger 20 is attracted against the force of the spring 34 toward the core 30 until the collar 24 abuts the stopper 28. At the same time, the globe valve 10 separates from the valve seat 14 allowing the fuel, supplied from the fuel pressure source to the fuel inlet 36, to flow through the space, formed by the globe valve 10, the inner surface of the valve housing 12 and the valve seat 14, into the spiral fuel groove 38 of the spiral member 40. While passing through the fuel groove 38, the fuel is given a spiraling movement perpendicular to the direction of injection and, after flowing past the outlet 42, is diffused so as to be atomized.

Thus, since the fuel does not swirl when passing through the valve seat 14, there is no need to increase the fuel passage area at the valve seat 14, i.e., the valve stroke need not be increased, which is necessary when the fuel is swirled and the apparent flow coefficient increases. This in turn enables a reduction in the period of time after the valve starts to move until it becomes stable. In other words it is possible to shorten the time it takes for the fuel, after starting to flow, to be able to be stably controlled. This makes it possible to perform accurate control in the range of small energizing current pulse width, i.e., in the range of small fuel flow.

In addition, since the valve seat 14 is not provided between the spiral member 40 to swirl the fuel, the space between the spiral member 40 and the outlet orifice 42 in which the fuel can become stagnant is small. This reduces the amount of fuel that is injected from the outlet orifice 42 without being swirled when the fuel begins to be injected, thus improving the control performance in the range of small fuel flow. Further, since the fuel is not metered by the inlet orifice 36, the inlet orifice 36 does not require high precision machining.

In addition to the above, the fuel injection valve of this invention has the following advantages. Since the fuel is fed from a position immediately upstream of the valve seat 14, there are only the valve seat 14 and the spiral member 40 that the fuel must flow past to reach the fuel metering outlet orifice 42, so that, at the start of fuel injection, the fuel pressure reduction just before the outlet orifice 42 can be minimized to ensure sufficient flow speed of fuel passing through the spiral member 40. This eliminates the disadvantage of the conventional fuel injection valve that when the fuel bagins to be injected, the diffusion angle of the spray fuel is small. Furthermore, since it is not necessary to provide the fuel passage within the valve housing 12 on the yoke side of the globe valve 10, the structure becomes simple and the moving unit 20 can be guided with high accuracy, thus eliminating the unstable fuel flow due to the unstable movement of the moving unit 20.

Therefore, with this invention in which the fuel injection valve is controlled by pulses, the diffusing angle of the sprayed fuel at the start of injection can be increased, thus improving the control performance in the range of small control pulse width or small fuel injection as well as the quality of atomized fuel.

We claim:

1. A magnetic fuel injection valve comprising a coil; a core provided at a center of the coil; a yoke formed around the coil and connected with the core; a plunger facing one end of the core and slidable along a central axis of the yoke; a globe valve formed at the other end of plunger on an opposite side of the core; a valve housing connected to the yoke, the globe valve being adapted to slide inside the valve housing; a valve seat facing the globe valve, the valve housing being adapted to guide the outer surface of the globe valve in sliding movement thereof to align the center of the globe valve with that of the valve seat; a radially extending fuel inlet passage communicating an outer surface of the valve housing with an immediate upstream side of the valve seat inside the valve housing, the fuel inlet passage being formed so that the fuel is not swirled at the upstream side of the valve seat;

means provided at the downstream side of the valve seat for generating a spiraling movement in outgoing fuel in a direction perpendicular to a direction of injection; and a fuel metering orifice provided downstream of the spiraling flow generating means; the valve housing is adapted to engage an outer surface of the globe valve during an entire stroke of sliding movement of the globe valve for aligning the center of the globe valve with that of the valve seat, and an inner opening of the fuel inlet passage is formed between the valve seat and a narrowest portion of a gap between the glove valve and the inner surface of the valve housing.

2. A magnetic fuel injection valve as set forth claim 1, wherein the spiraling flow generating means is a rod circular in cross section provided with a spiral fuel groove.

3. An electromagnetic fuel injection valve comprising:

an axially extending moving unit having a globe valve at one end thereof;

means for electromagnetically actuating said moving unit in an axial direction of said moving unit;

a valve housing means mechanically connected to said electromagnetically actuating means and having a cylindrical bore in which said globe valve is slidably inserted;

a valve seat provided at one end portion of said cylindrical bore and being adapted to contact said globe valve, the valve housing being adapted to engage the outer surface of the globe valve during the whole stroke of sliding movement of the globe valve to align the center of the globe valve with that of the valve seat;

at least one fuel inlet passage provided in said valve housing means immediately upstream of said valve seat, an inner opening of said fuel inlet passage extending in a direction toward a center axis of said moving unit;

means provided immediately downstream of the valve seat for imparting a spiraling movement to fuel discharged along the center axis of said moving unit; and a fuel metering orifice provided downstream of said spiraling movement imparting means.

4. An electromagnetic fuel injection valve as set forth in claim 3, wherein an inner diameter of said valve housing and an outer diameter of said globe valve are substantially equal to each other so that said globe valve is guided by an inside surface of said valve housing means, and said inner opening of said inlet passage is formed between said valve seat and a narrowest portion of a gap defined by an outer surface of said globe valve and the inside surface of said valve housing means.

5. An electromagnetic valve as set forth in claim 4, wherein said spriraling movement imparting means includes a rod having a substantially circular cross section, said rod being provided with a spiral fuel groove through which the fuel is directed.

6. An electromagnetic fuel injection valve as set forth in claim 3, wherein a plurality of fuel inlet passages are provided, said fuel inlet passage being equal angularly spaced from each other.

7. An electromagnetic fuel injection valve as set forth in claim 3, wherein said spiraling movement imparting means includes a rod having a substantially circular cross section, said rod being provided with a spiral fuel groove through which the fuel is directed.

* * * * *